US010008833B1

(12) United States Patent
Sumoyama et al.

(10) Patent No.: US 10,008,833 B1
(45) Date of Patent: Jun. 26, 2018

(54) SPARK PLUG

(71) Applicant: NGK SPARK PLUG CO., LTD., Nagoya-shi, Aichi (JP)

(72) Inventors: Daisuke Sumoyama, Nagoya (JP); Tatsuya Gozawa, Komaki (JP); Tsutomu Shibata, Owariasahi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days. days.

(21) Appl. No.: 15/865,788

(22) Filed: Jan. 9, 2018

(30) Foreign Application Priority Data

Jan. 25, 2017 (JP) ..... 2017-011022

(51) Int. Cl.

| | |
|---|---|
| ***H01T 13/20*** | (2006.01) |
| ***H01T 13/39*** | (2006.01) |
| ***C22C 5/04*** | (2006.01) |
| ***H01T 21/02*** | (2006.01) |
| ***H01T 13/32*** | (2006.01) |

(52) U.S. Cl.
CPC ..... *H01T 13/39* (2013.01); *C22C 5/04* (2013.01); *H01T 13/32* (2013.01); *H01T 21/02* (2013.01)

(58) Field of Classification Search
USPC ..... 313/141, 144, 118
See application file for complete search history.

(56) References Cited

U.S. PATENT DOCUMENTS

2010/0242888 A1 9/2010 Torii et al.
2011/0163653 A1 7/2011 Torii et al.

FOREIGN PATENT DOCUMENTS

WO WO 2009/063930 A1 5/2009
WO WO 2010/029944 A1 3/2010

*Primary Examiner* — Vip Patel
(74) *Attorney, Agent, or Firm* — Kusner & Jaffe

(57) ABSTRACT

A spark plug having a tip formed of an alloy containing Pt. The tip contains not less than 6 mass % of Rh, at least one element selected from an R group consisting of Rh, Re, Ir, Ru, W, Mo, and Nb, not less than 5 mass % of Ni, and at least one element selected from an N group consisting of Ni, Co, Fe, and Cu. The tip contains Rh most among the elements of the R group, and contains Ni most among the elements of the N group. The total of contents of Pt, Rh, and Ni is not less than 91 mass %, and the total of contents of Pt, the R group, and the N group is not less than 95 mass %. A value obtained by dividing the content of the R group by the content of the N group is not less than 0.7 and not greater than 8.

7 Claims, 3 Drawing Sheets

SPARK PLUG

RELATED APPLICATIONS

This application claims the benefit of Japanese Patent Application No. 2017-011022, filed Jan. 25, 2017, the entire contents of which are incorporated herein by reference.

FIELD OF THE INVENTION

The present invention relates to a spark plug, and particularly to a spark plug having an electrode which includes a tip formed of an alloy containing Pt as a main material.

BACKGROUND OF THE INVENTION

A spark plug has been known in which an electrode includes an intermediate member interposed between an electrode base member and a tip formed of an alloy containing Pt as a main material, in order to inhibit flame quenching in which the electrode deprives the energy of a flame kernel. In a spark plug disclosed in International Publication No. 2010/029944, a first electrode opposing a second electrode with a spark gap includes: an electrode base member containing Ni as a main material; an intermediate member that is formed of an alloy containing Ni as a main material and is welded to the electrode base member so as to protrude from the electrode base member; and a melt portion formed by melting the intermediate member and a tip formed of Pt—Rh together. A first electrode of a spark plug disclosed in International Publication No. 2009/063930 includes: an electrode base member containing Ni as a main material; an intermediate member containing Ni as a main material; and a melt portion formed by melting the intermediate member and a tip formed of Pt—Ni together.

However, in the technique disclosed in International Publication No. 2010/029944, partial wear (hereinafter also referred to as "hollow") of the melt portion may occur when the spark plug is used at a high temperature. In the technique disclosed in International Publication No. 2009/063930, wear of the intermediate member may occur when the spark plug is used at a high temperature or in an engine with a supercharger.

The present invention is made in order to address the aforementioned problems. An advantage of the present invention is a spark plug capable of improving wear resistances of the intermediate member and the melt portion.

SUMMARY OF THE INVENTION

In accordance with a first aspect of the present invention, there is provided a spark plug having a first electrode that includes: an electrode base member containing Ni as a main material; an intermediate member which is formed of an alloy containing Ni as a main material, and is welded to the electrode base member so as to protrude from the electrode base member, a tip formed of an alloy containing Pt as a main material; and a melt portion formed by melting the intermediate member and the tip together. A second electrode opposes a discharge surface of the tip with a spark gap.

The tip contains not less than 6 mass % of Rh, at least one element selected from an R group consisting of Rh, Re, Ir, Ru, W, Mo, and Nb, not less than 5 mass % of Ni, and at least one element selected from an N group consisting of Ni, Co, Fe, and Cu. The tip contains Rh most among the elements of the R group, and contains Ni most among the elements of the N group. The total of contents of Pt, Rh, and Ni is not less than 91 mass %, and the total of contents of Pt, the R group, and the N group is not less than 95 mass %. A value obtained by dividing the content of the R group by the content of the N group is not less than 0.7 and not greater than 8.

In the spark plug according to a first aspect, the tip containing Pt as a main material further contains not less than 6 mass % of Rh, at least one element selected from an R group consisting of Rh, Re, Ir, Ru, W, Mo, and Nb, not less than 5 mass % of Ni, and at least one element selected from an N group consisting of Ni, Co, Fe, and Cu. The tip contains Rh most among the elements of the R group, and contains Ni most among the elements of the N group. As a result, Pt, Rh, and Ni are contained in the melt portion formed by melting the tip and the intermediate member together. Since the melt portion can be made moderately brittle while inhibiting thermal stress by the alloy containing Pt, Rh, and Ni, a moderate crack can be advanced into the melt portion by thermal shock or the like to release the stress. Since the stress in the intermediate member can be reduced, deformation of the intermediate member can be inhibited. As a result, peeling of a stable oxide film formed on the surface of the intermediate member can be inhibited, whereby a portion covered with the oxide film, which is likely to wear due to oxidation, can be prevented from being exposed. Consequently, oxidation wear of the intermediate member 20 can be inhibited.

The total of the contents of Pt, Rh, and Ni is not less than 91 mass %, and the total of the contents of Pt, the R group, and the N group is not less than 95 mass %. The value obtained by dividing the content of the R group by the content of the N group is not less than 0.7 and not greater than 8. Therefore, occurrence of thermal stress in the melt portion can be inhibited while inhibiting reduction of the melting points of the tip and the melt portion to inhibit growth of crystal grains. Furthermore, the stable oxide film is formed on the surface of the melt portion 21 to inhibit further internal oxidation. As a result, excessive embrittlement of the melt portion can be inhibited and stress in the melt portion can be reduced, and wear due to oxidation and/or falling-off of oxides can be inhibited, whereby partial wear (hollow) of the melt portion at high temperature can be inhibited.

The tip, which contains Pt, Rh, and Ni and has the value obtained by dividing the content of the R group by the content of the N group being not less than 0.7 and not greater than 8, has a high melting point and is less likely to be melted during welding. Since the melt portion can be formed in a moderate size, the distance between the intermediate member and the second electrode can be ensured. Therefore, spark wear of the intermediate member can be inhibited. As described above, spark wear and oxidation wear of the intermediate member as well as hollow of the melt portion can be inhibited, thereby providing an effect of improving wear resistances of the intermediate member and the melt portion.

In accordance with a second aspect of the present invention, there is provided a spark plug, as described above, wherein the tip has a grain structure in which the crystal grain size at a cross-section parallel to the discharge surface is not greater than 160 μm. Therefore, concentration of stress to a specific crystal grain boundary can be made less likely to occur, whereby a crack can be made less likely to occur at the crystal grain boundary. As a result, falling-off of crystal grains can be inhibited.

Assuming that Vickers hardness at the cross-section of the tip after heat treatment on the tip at 1200° C. in an Ar atmosphere for 10 hours is Ha and Vickers hardness at the cross-section of the tip before the heat treatment is Hb, the grain structure and the composition of the tip are set to satisfy Hb/Ha≤2.25. In addition, since the tip contains Pt, Rh, and Ni, strength thereof at high temperature can be ensured. Therefore, recrystallization and grain growth in the tip at high temperature can be inhibited. Therefore, in addition to the effect of the first aspect, intercrystalline cracking of the tip, falling-off of crystal grains, and deformation of the tip can be inhibited.

In accordance with a third aspect of the present invention, there is provided a spark plug, as described above, wherein Hb/Ha obtained by dividing the Vickers hardness Hb by the Vickers hardness Ha satisfies Hb/Ha≤2.15. Therefore, in addition to the effect of the second aspect, the effect of inhibiting intercrystalline cracking and deformation of the tip can be further improved.

In accordance with a fourth aspect of the present invention, there is provided a spark plug, as described above, wherein the tip contains not less than 8 mass % of Ni. Therefore, diffusion of the elements in the melt portion into which the tip is partially melted, can be facilitated. Although Ni is more likely to be oxidized and more likely to disappear at high temperature as compared to Rh, influence by such a property of Ni can be reduced by setting the content of Ni to not less than 8 mass %. As a result, a stable oxide film can be easily formed at the surface of the melt portion, thereby inhibiting oxidation of the melt portion. Therefore, in addition to the effect of any of the first to third aspects, the melt portion can be made less likely to be hollowed.

In accordance with a fifth aspect of the present invention, there is provided a spark plug, as described above, wherein the value obtained by dividing the content of the R group by the content of the N group is not greater than 5. When the content of the N group is relatively higher than the content of the R group, the melt portion can be made less likely to be brittle, and linear expansion coefficients of the tip and the melt portion can be increased, whereby thermal stress that occurs in the melt portion can be reduced. Furthermore, diffusion of the elements in the melt portion into which the tip is partially melded can be facilitated, whereby a stable oxide film can be formed at the surface of the melt portion to inhibit further internal oxidation. Therefore, in addition to the effect of any of the first to fourth aspects, the melt portion can be made less likely to be hollowed.

In accordance with a sixth aspect of the present invention, there is provided a spark plug, as described above, wherein the intermediate member contains not less than 50 mass % of Ni, not less than 15 mass % of Cr, and not less than 0 mass % and not greater than 15 mass % of Fe. Therefore, a dense oxide film of Cr can be easily formed on the surface of the intermediate member. Thus, in addition to the effect of any of the first to fifth aspects, oxidation wear of the intermediate member can be further inhibited.

In accordance with a seventh aspect of the present invention, there is provided a spark plug, as described above, wherein the total of the contents of Pt, Rh, and Ni is not less than 96 mass %. Therefore, the melt portion into which Pt, Rh, and Ni are melted can be made less likely to be oxidized. Thus, in addition to the effect of any of the first to sixth aspects, the melt portion can be inhibited from being hollowed.

DETAILED DESCRIPTION OF THE INVENTION

Figure 1:
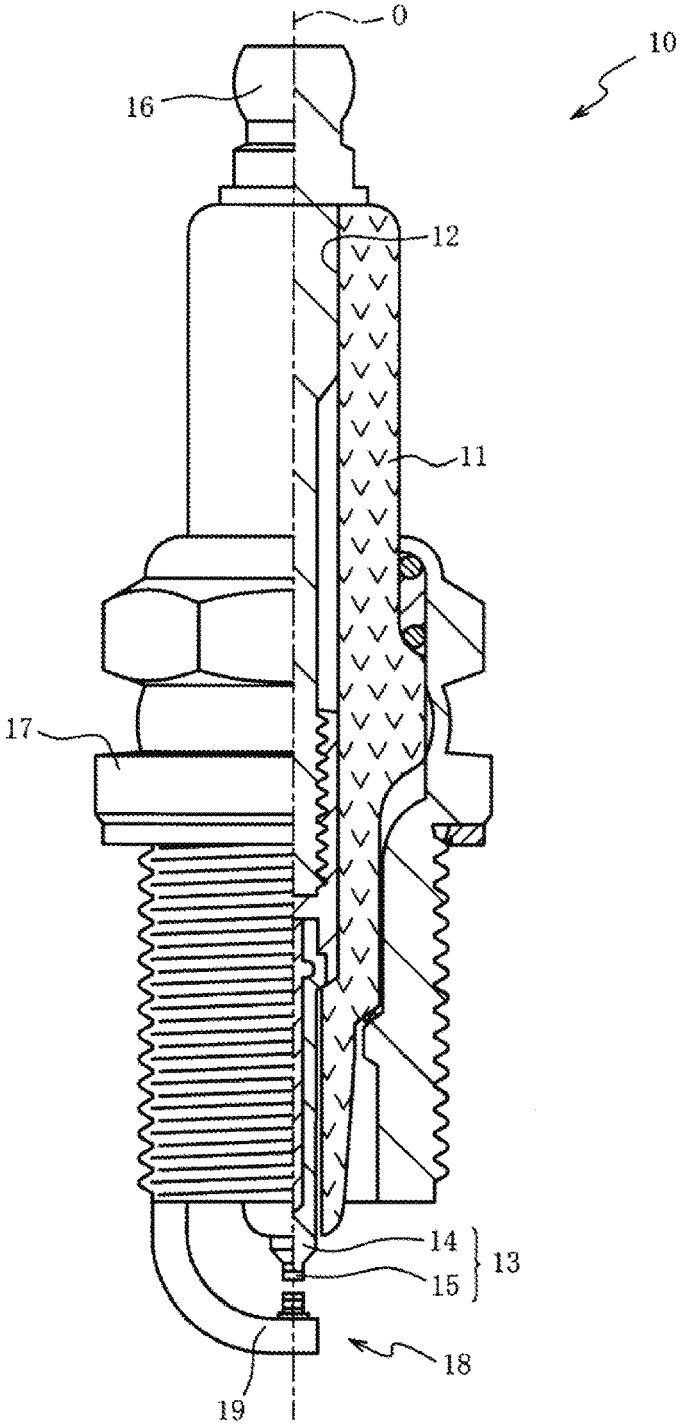
FIG. 1 is a half sectional view of a spark plug according to one embodiment of the present invention.
Figure 2:
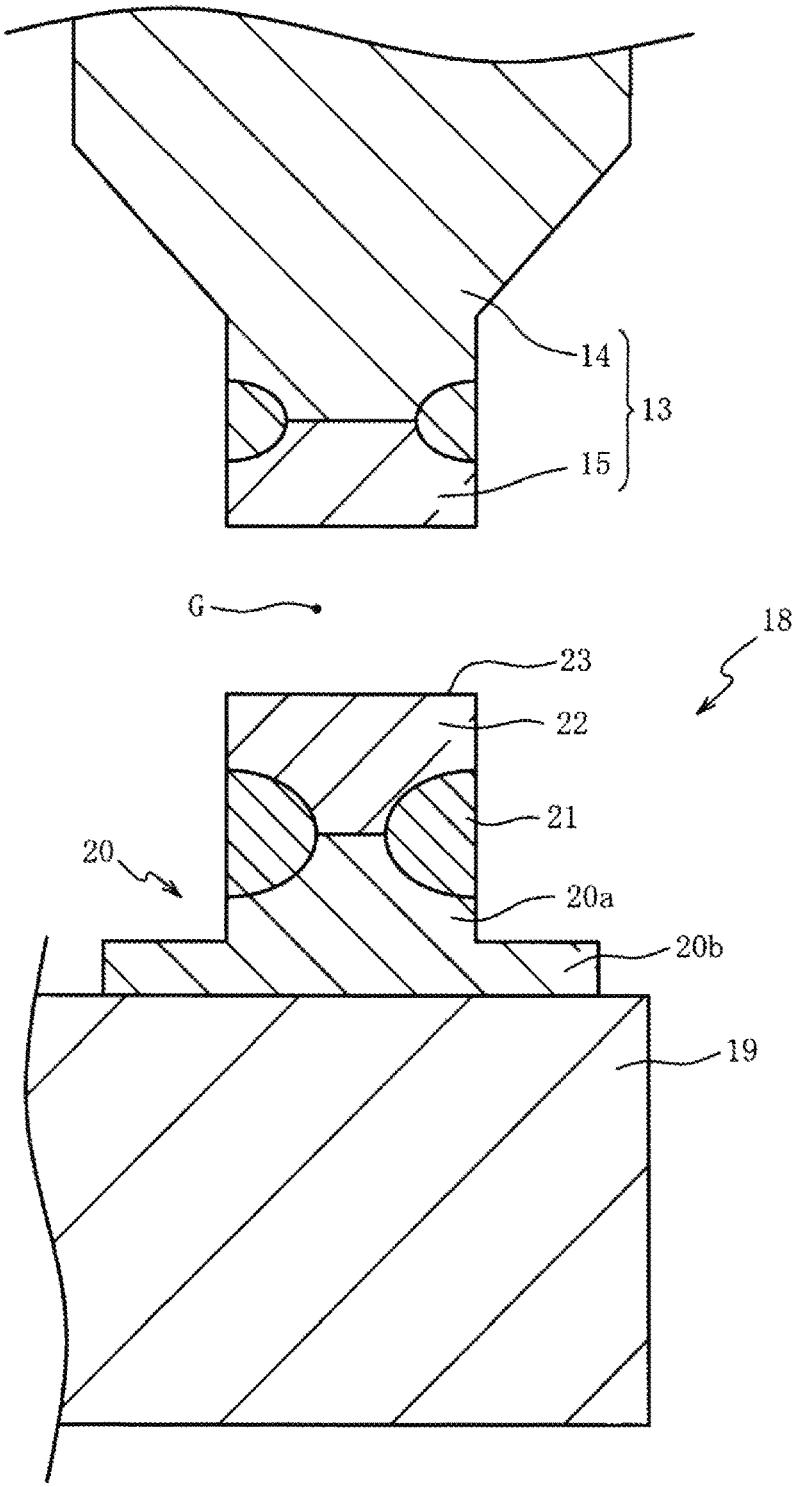
FIG. 2 is a cross-sectional view of a center electrode and a ground electrode.

Hereinafter, a preferred embodiment of the present invention will be described with reference to the accompanying drawings. FIG. 1 is a half sectional view, with an axial line O as a boundary, of a spark plug 10 according to one embodiment of the present invention. FIG. 2 shows cross-sectional views of a center electrode 13 and a ground electrode 18, including the axial line O. In FIGS. 1 and 2, the lower side on the surface of the drawing sheet is referred to as a front side of the spark plug 10, and the upper side on the surface of the drawing sheet is referred to as the rear side of the spark plug 10.

As shown in FIG. 1, the spark plug 10 includes an insulator 11, a center electrode 13 (second electrode), a metal shell 17, and a ground electrode 18 (first electrode). The insulator 11 is a substantially cylindrical member formed of alumina or the like which is excellent in mechanical property and insulation property at high temperature. The insulator 11 has an axial hole 12 which penetrates therethrough along the axial line O.

The center electrode 13 is a rod-shaped electrode which is inserted in the axial hole 12 and held by the insulator 11 along the axial line O. The center electrode 13 includes an electrode base member 14, and a tip 15 joined to a front end of the electrode base member 14. In the electrode base member 14, a core member having excellent thermal conductivity is embedded. The electrode base member 14 is formed of an alloy containing Ni as a main material, or a metal material made of Ni. The core member is formed of copper or an alloy containing copper as a main material. The tip 15 is formed of a noble metal having higher spark wear resistance than the electrode base member 14, such as platinum, iridium, ruthenium, or rhodium, or is formed of an alloy containing the noble metal as a main material.

The metal terminal 16 is a rod-shaped member to which a high-voltage cable (not shown) is connected, and a front side portion of the metal terminal 16 is disposed in the insulator 11. The metal terminal 16 is electrically connected to the center electrode 13 in the axial hole 12.

The metal shell 17 is a substantially cylindrical member formed of a metal, and is fixed to a screw hole (not shown) of a combustion engine. The metal shell 17 is formed of a metal material (e.g., low-carbon steel or the like) having conductivity. The metal shell 17 is fixed to an outer periphery of the insulator 11. An electrode base member 19 of the ground electrode 18 is joined to a front end of the metal shell 17. The electrode base member 19 (refer to FIG. 1) is bent toward the center electrode 13.

As shown in FIG. 2, the ground electrode 18 includes: the electrode base member 19; an intermediate member 20 joined to the electrode base member 19; a melt portion 21 joined to the intermediate member 20; and a tip 22 joined to the intermediate member 20 via the melt portion 21. In the electrode base member 19, a core member having excellent thermal conductivity is embedded. The electrode base member 19 is formed of an alloy containing Ni as a main material, or a metal material formed of Ni. The core member is formed of copper or an alloy containing copper as a main material. As a matter of course, the core member may be omitted and the entirety of the electrode base member 19 may be formed of an alloy containing Ni as a main material, or a metal material formed of Ni.

The intermediate member 20 includes: a column portion 20*a* having a cylindrical shape; and a flange portion 20*b* which is connected to a portion, on the electrode base member 19 side, of the column portion 20*a*. The flange portion 20*b* has a flange-like shape, the diameter of which increases in the radial direction. The intermediate member 20 is joined to the electrode base member 19 so as to protrude from the electrode base member 19, by resistance welding, laser welding, or the like. The intermediate member 20 may be formed in a truncated corn shape, the outer diameter of which gradually decreases from the electrode base member 19 toward the center electrode 13.

The spark plug 10 is manufactured by the following method, for example. First, the center electrode 13 is inserted in the axial hole 12 of the insulator 11. The center electrode 13 is disposed such that a front end thereof is exposed to the outside from the axial hole 12. The metal terminal 16 is inserted in the axial hole 12, and conduction between the metal terminal 16 and the center electrode 13 is ensured. Thereafter, the metal shell 17 to which the electrode base member 19 is joined in advance is mounted to the outer periphery of the insulator 11. After the intermediate member 20 and the tip 22 are joined to each other by laser beam welding or electron beam welding, the intermediate member 20 is joined to the electrode base member 19. The intermediate member 20 and the tip 22 may be joined to each other by laser beam welding or electron beam welding after the intermediate member 20 is joined to the electrode base member 19. Next, the electrode base member 19 is bent such that the tip 22 opposes the center electrode 13 in the direction of the axial line O, thereby obtaining the spark plug 10.

The intermediate member 20 is formed of an alloy containing Ni as a main material. The intermediate member 20 preferably contains: not less than 50 mass % of Ni; not less than 15 mass % of Cr; and not less than 0 mass % and not greater than 15 mass % of Fe. Thus, a dense and stable oxide film is formed on the surface of the intermediate member 20 to inhibit further internal oxidation of the intermediate member 20, thereby improving resistance to oxidation at high temperature. If Fe is contained in the intermediate member 20, the content of Fe in the alloy forming the intermediate member 20 is set to be not greater than 15 mass %. In order to improve resistance to oxidation at high temperature and high-temperature strength, the intermediate member 20 may further contain one or more elements selected from Al, Si, Mn, Ti, Y, Hf, Zr, lanthanoid, B, C, Co, Cu, and the like, other than inevitable impurities.

The tip 22 is joined to the intermediate member 20 via the melt portion 21. The tip 22 is formed in a cylindrical shape having a flat discharge surface 23. The tip 22 is joined to the intermediate member 20 so as to protrude from the electrode base member 19 together with the intermediate member 20, and opposes the center electrode 13 to form a spark gap G between the discharge surface 23 thereof and the center electrode 13.

The melt portion 21 is formed by melting the intermediate member 20 and the tip 22 together. In this embodiment, after the end surfaces of the tip 22 and the intermediate member 20 are caused to abut against each other, laser beam or electron beam is applied to the boundary between the tip 22 and the intermediate member 20 throughout the entire periphery, thereby forming the melt portion 21. In FIG. 2, center portions of the abutting end surfaces of the tip 22 and the intermediate member 20 remain unmelted. However, the present invention is not limited thereto. The abutting end surfaces may be completely melted into the melt portion 21 to disappear. The melt portion 21 reduces thermal stress in the tip 22, which is caused by a difference in linear expansion coefficient between the tip 22 and the intermediate member 20. In the intermediate member 20, the melt portion 21 is formed at a position distant from the electrode base member 19.

The tip 22 is formed of an alloy containing Pt as a main material. The "alloy containing Pt as a main material" means an alloy in which the content of Pt is the highest, and does not mean an alloy in which the content of Pt is not less than 50 mass %. The tip 22 contains at least one element selected from an R group consisting of Rh, Re, Ir, Ru, W, Mo, and Nb, and at least one element selected from an N group consisting of Ni, Co, Fe, and Cu. Besides the elements of the R group and the N group, the tip 22 may contain elements such as Au, Ag, Pd, Mn, and Cr, other than inevitable impurities.

The elements of the R group prevent reduction of the melting points of the tip 22 and the melt portion 21 to inhibit growth of crystal grains, and make the melt portion 21 brittle. The elements of the N group reduce the melting point of the tip 22, and increase the linear expansion coefficient of the melt portion 21 to reduce the thermal stress, and moreover, facilitate diffusion of the elements such as Cr, Al, and Si contained in the melt portion 21. Since the tip 22 contains Rh most among the elements of the R group and contains Ni most among the elements of the N group, these functions can be enhanced.

The tip 22 contains not less than 6 mass % of Rh, and not less than 5 mass % of Ni. Since the melt portion 21 contains Pt, Rh, and Ni, the melt portion 21 can be made moderately brittle while inhibiting occurrence of thermal stress in the intermediate member 20. Therefore, a moderate crack can be advanced into the melt portion 21 by thermal shock or the like to release the stress. Since the stress in the intermediate member 20 can be reduced, deformation of the intermediate member 20 can be inhibited. As a result, peeling of the stable oxide film formed on the surface of the intermediate member 20 can be inhibited, whereby a portion covered with the oxide film, which is likely to wear due to oxidation, can be prevented from being exposed. Consequently, oxidation wear of the intermediate member 20 can be inhibited.

When the content of the elements of the N group relative to the content of the elements of the R group is increased in the tip 22 or the melt portion 21, the linear expansion coefficients of the tip 22 and the melt portion 21 can be increased, whereby thermal stress that occurs in the melt portion 21 can be reduced. Further, diffusion of the elements such as Cr, Al, and Si contained in the melt portion 21 can be facilitated, whereby a stable oxide film can be easily formed on the surface of the melt portion 21. Even if the oxide film peels, diffusion of the elements allows the oxide film to be reproduced on the surface of the melt portion 21.

The total of the contents of Pt, Rh, and Ni contained in the tip 22 is not less than 91 mass %, and the total of the contents of Pt, the R group, and the N group contained in the tip 22 is not less than 95 mass %. Since a value obtained by dividing the content of the R group by the content of the N group is not less than 0.7 and not greater than 8, excessive embrittlement of the melt portion 21 can be inhibited, and occurrence of thermal stress in the melt portion 21 can be inhibited while inhibiting reduction of the melting points of the tip 22 and the melt portion 21 to inhibit growth of crystal grains. Furthermore, since the stable oxide film can be formed on the surface of the melt portion 21 to inhibit further internal oxidation, stress in the melt portion 21 due to internal oxidation can be reduced. As a result, partial wear (hollow) of the melt portion 21 at high temperature can be inhibited.

The content of Ni is more preferably not less than 8 mass %. In this case, diffusion of the elements in the melt portion 21 can be facilitated. Although Ni is more likely to be oxidized and more likely to disappear at high temperature as compared to Rh, influence by such a property of Ni can be reduced by containing a large amount of Ni in advance. Since a stable oxide film can be easily formed on the surface of the melt portion 21, oxidation of the melt portion 21 can be inhibited. Therefore, the melt portion 21 can be made less likely to be hollowed.

The value obtained by dividing the content of the R group by the content of the N group is more preferably not greater than 5. In this case, a stable oxide film can be easily formed on the surface of the melt portion 21, and even if the oxide film peels, diffusion of the elements allows the oxide film to be reproduced on the surface of the melt portion 21. Furthermore, the melt portion 21 can be made less likely to be brittle, and the linear expansion coefficient of the melt portion 21 can be increased, whereby thermal stress that occurs in the melt portion 21 can be reduced. Therefore, the melt portion 21 can be made less likely to be hollowed.

The total of the contents of Pt, Rh, and Ni is more preferably not less than 96 mass %. In this case, oxidation of the melt portion 21 into which Pt, Rh, and Ni are melted can be inhibited. As a result, the melt portion 21 can be further inhibited from being hollowed.

Since the intermediate member 20 containing Ni as a main material protrudes from the electrode base member 19, discharge may occur between the center electrode 13 and the intermediate member 20, which may cause spark wear. In order to prevent spark wear of the intermediate member 20, it is important to increase the distance between the intermediate member 20 and the center electrode 13. Usually, since the melt portion 21 is formed between the tip 22 and the intermediate member 20, the distance between the intermediate member 20 and the center electrode 13 can be increased by the melt portion 21.

Generally, the melt portion 21 is formed such that the tip 22 having a predetermined length or more remains in the direction of the axial line O (center line). In order to ensure the length of the tip 22, when the tip 22 having a low melting point, energy of welding applied to the intermediate member 20 and the tip 22 is made lower as compared to the case of using the tip 22 having a high melting point. Then, since the intermediate member 20 is less likely to melt (the melt portion 21 becomes small), the distance between the intermediate member 20 and the center electrode 13 is reduced as compared to the case of using the tip 22 having a high melting point, and spark wear of the intermediate member 20 is more likely to occur.

On the other hand, when energy of welding applied to the intermediate member 20 and the tip 22 is increased, the melt portion 21 becomes large, and the distance between the intermediate member 20 and the center electrode 13 can be increased. However, since melting of the tip 22 into the melt portion 21 is increased, the length of the tip 22 in the direction of the axial line O is shortened, resulting in reduction of life of the spark plug 10.

According to the present embodiment, the tip 22, which contains Pt, Rh, and Ni and has the value obtained by dividing the content of the R group by the content of the N group being not less than 0.7 and not greater than 8, has a high melting point, and therefore is less likely to melt during welding. Since the melt portion 21 can be formed in a moderate size, the distance between the intermediate member 20 and the center electrode 13 can be ensured, whereby spark wear of the intermediate member 20 can be inhibited.

Figure 3:
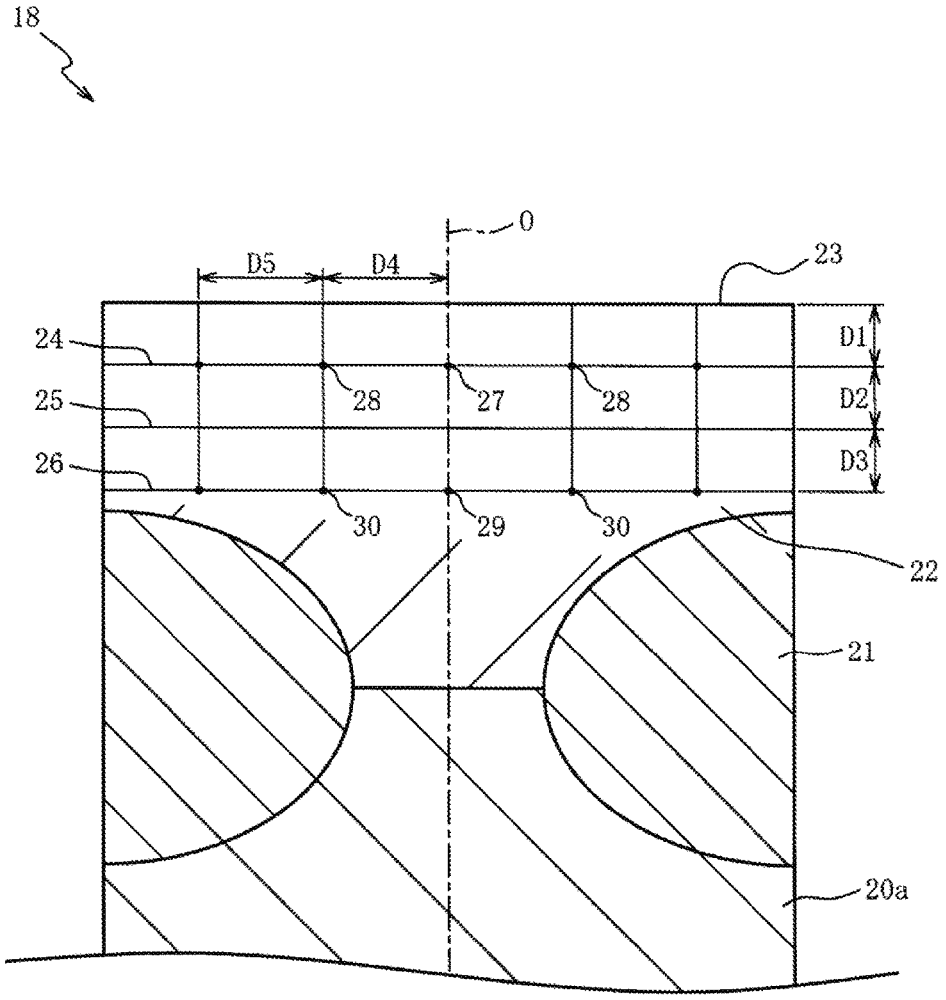
FIG. 3 is a cross-sectional view of the ground electrode, including an axial line.

Next, a grain structure of the tip 22 will be described with reference to FIG. 3. FIG. 3 is a cross-sectional view of the ground electrode 18, including the axial line O. The grain structure of the tip 22 is prepared such that a crystal grain size in a cross-section parallel to the discharge surface 23 is not greater than 160 μm. The crystal grain size is measured in accordance with JIS G0551 (2013). A specific measurement method will be described below.

As shown in FIG. 3, the tip 22 (which has been thermally affected by formation of the melt portion 21) joined to the electrode base member 19 is polished so that a flat cross-section including the axial line O (center line) of the tip 22 is exposed, and a photomicrograph of a composition image is obtained by using a metallographical microscope or an SEM.

On the photomicrograph obtained, three test lines 24, 25, and 26, each being a straight line, are drawn in parallel to the discharge surface 23 of the tip 22. A distance D1 between the discharge surface 23 and the test line 24, a distance D2 between the test line 24 and the test line 25, and a distance D3 between the test line 25 and the test line 26 each are 0.05 mm. However, if the three test lines 24, 25, and 26 cannot be drawn at intervals of 0.05 mm because the length of the tip 22 in the direction of the axial line O is short, all the distances D1, D2, and D3 may be shortened, or only the distance D1 may be shortened.

Next, the number of crystal grains through which the test line 24 passes or which is captured by the test line 24 (number of captured crystal grains $N_1$), the number of crystal grains through which the test line 25 passes or which is captured by the test line 25 (number of captured crystal grains $N_2$), and the number of crystal grains through which the test line 26 passes or which is captured by the test line 26 (number of captured crystal grains $N_3$), are counted. Counting of the number of captured crystal grains is performed on the basis of the manner of crossing of each test lines 24, 25, 26 and a crystal grain. That is, when the test line 24, 25, 26 passes through a crystal grain, $N_1$, $N_2$, $N_3$=1. When the test line 24, 25, 26 terminates within a crystal grain, $N_1$, $N_2$, $N_3$=0.5. When the test line 24, 25, 26 is in contact with a crystal grain boundary, $N_1$, $N_2$, $N_3$=0.5. Assuming that the length of a portion, of the test line 24, 25, 26, crossing a crystal grain is $X_1$, $X_2$, $X_3$, respectively, the crystal grain size is represented by $(X_1+X_2+X_3)/(N_1+N_2+N_3)$.

The purpose of paying attention to the crystal grain size at the cross-section parallel to the discharge surface 23 with the straight lines parallel to the discharge surface 23 of the tip 22 being the test lines 24, 25, and 26, is to control the crystal grain size at the cross-section parallel to the discharge surface 23, thereby preventing falling-off of the crystal grains from the discharge surface 23 when discharge is repeated at the discharge surface 23.

Since the crystal grain size at the cross-section parallel to the discharge surface 23 is not greater than 160 μm, concentration of stress to a specific crystal grain boundary can be made less likely to occur, whereby a crack can be made less likely to occur at the crystal grain boundary. Since the tip 22 contains Pt, Rh, and Ni, strength of the tip 22 at high temperature can be ensured. As a result, it is possible to inhibit falling-off of the crystal grains from the discharge surface 23, advance of cracks from the discharge surface 23, and deformation of the tip 22.

Assuming that Vickers hardness at the cross-section of the tip 22 after heat treatment on the tip 22 at 1200° C. in an Ar atmosphere for 10 hours is Ha, and Vickers hardness at the cross-section of the tip 22 before the heat treatment is Hb, the grain structure and the composition of the tip 22 are set so that Hb/Ha≤2.25 is satisfied. The grain structure and the hardness of the tip 22 can be controlled by: the welding method; the atmosphere during welding; the irradiation condition of laser beam or electron beam used for welding; the material, the shape, etc. of the intermediate member 20 (the length or the cross-sectional area of the tip 22 in the direction of the axial line O); the processing condition when the tip 22 is manufactured; and the like.

The Vickers hardness of the tip 22 is measured on the basis of JIS Z2244 (2009). First, regarding the tip 22 (which has been thermally affected by formation of the melt portion 21) joined to the electrode base member 19, this tip 22 is cut along a plane including the axial line O (center line) of the tip 22 to be divided into two parts. The cut surface of one of the two parts is mirror-finished to provide a test piece for measurement of Vickers hardness Hb. The other part is subjected to heat treatment at 1200° C. in an Ar atmosphere for 10 hours, and thereafter, the cut surface thereof is mirror-finished to provide a test piece for measurement of Vickers hardness Ha.

If it is not possible to form test pieces by cutting the tip 22 into two parts, two spark plugs 10 manufactured under the same condition are prepared, and a test piece for measurement of Vickers hardness Hb may be formed by using one of the spark plugs 10 while a test piece for measurement of Vickers hardness Ha may be formed by using the other spark plug 10.

The test piece for measurement of Vickers hardness Ha is subjected to heat treatment before the cut surface thereof is mirror-finished. This heat treatment is a process including: putting, in an atmosphere furnace, the tip 22 (the electrode base member 19 and the melt portion 21 may be included) which has been thermally affected by formation of the melt portion 21; increasing the temperature at a rate of 10° C./min up to 1200° C. while flowing Ar at a flow rate of 2 L/min; maintaining heating at 1200° C. for 10 hours; stopping the heating; and naturally cooling the tip 22 while flowing Ar at a flow rate of 2 L/min. The purpose of the heat treatment is to remove residual stress from the tip 22, and to adjust the crystal grain structure of the tip 22 which has been changed due to influences of the processing, the welding heat, etc., thereby to reduce the hardness of the tip 22 to the hardness derived from the composition thereof.

Measurement points (points at which indenters are pushed into the tip 22) of the Vickers hardness Ha, Hb will be described with reference to FIG. 3. At the cross-section including the axial line O (center line) of the tip 22, a measurement point 27 is taken, which is distant by a distance D1 (0.05 mm) from the discharge surface 23 toward the intermediate member 20 side in the direction of the axial line O. On a straight line that passes the measurement point 27 and is parallel to the discharge surface 23, a plurality of measurement points 28 are taken at intervals of 0.1 mm. Further, a measurement point 29 is taken, which is distant by a distance of D1+D2+D3 (0.15 mm) from the discharge surface 23 toward the intermediate member 20 side in the direction of the axial line O. On a straight line that passes the measurement point 29 and is parallel to the discharge surface 23, a plurality of measurement points 30 are taken at intervals of 0.1 mm. An indenter is pushed into the tip 22 at each of the plurality of measurement points 27, 28, 29, and 30 to measure the hardness. A test force applied to the indenter is 2N, and the test force holding time is 10 seconds. An arithmetic average value of measurement values obtained at the plurality of measurement points 27, 28, 29, and 30 is calculated to obtain Vickers hardness Ha, Hb.

When an indentation caused by pushing of the indenter during measurement of Vickers hardness Ha, Hb is included in the melt portion 21 or when an indentation is included in a region up to a position 0.02 mm distant from the discharge surface 23 toward the intermediate member 20 side in the direction of the axial line O, this indentation is excluded from the measurement values. The purpose of this is to minimize uncertainty of the hardness measurement.

When the ratio of the Vickers hardnesses Ha and Hb measured before and after the heat treatment satisfies Hb/Ha≤2.25, the recrystallization temperature of the tip 22 containing Pt, Rh, and Ni can be kept high, whereby recrystallization and grain growth at high temperature can be inhibited. In addition, since the tip 22 contains Pt, Rh, and Ni, the strength thereof at high temperature can be enhanced. Therefore, when the tip 22 contains Pt, Rh, and Ni, satisfies Hb/Ha≤2.25, and has the crystal grain size not greater than 160 μm at the cross-section parallel to the discharge surface 23, it is possible to inhibit intercrystalline cracking of the tip 22, falling-off of crystal grains, and deformation of the tip 22.

EXAMPLES

The present invention will be more specifically described according to examples. However, the present invention is not limited to the examples.

Example 1

Production of Samples 1 to 38

An examiner prepared: various cylindrical tips 22 having the same size and being composed of compositions shown in Table 1; and intermediate members 20 each including a column portion 20*a* of the same size and a flange portion 20*b* of the same size, and being composed of 75.0 wt % of Ni, 23.5 wt % of Cr, 0.5 wt % of Al, 1.0 wt % of Si, and inevitable impurities not more than a detection limit. After the end surfaces of each tip 22 and each intermediate member 20 were caused to abut against each other, laser beam was applied to the boundary between the tip 22 and the intermediate member 20 throughout the entire periphery by using a fiber laser welding machine. A melt portion 21 in which the abutting end faces were completely melted to disappear was formed between the tip 22 and the intermediate member 20, thereby joining the tip 22 and the intermediate member 20 together. The energy applied to the tip 22 and the intermediate member 20 by the fiber laser welding machine was controlled so that the tips 22, having different compositions, had the same length in the direction of the axial line O thereof after the welding.

TABLE 1

| | Tip | | | | | | | | | | | Wear of inter- | |
|---|---|---|---|---|---|---|---|---|---|---|---|---|---|
| | Pt | R group (wt %) | | | N group (wt %) | | | Others | | | | mediate | |
| No. | (wt %) | Rh | Ir | Ru | Ni | Co | Fe | (wt %) | Pt + Rh + Ni | Pt + R + N | R/N | member | Hollow |
| 1 | 80.0 | 20.0 | | | | | | | 100.0 | 100.0 | — | S | NG |
| 2 | 80.0 | | 20.0 | | | | | | 80.0 | 100.0 | — | S | NG |
| 3 | 91.0 | 3.0 | | | 6.0 | | | | 100.0 | 100.0 | 0.5 | NG | A |
| 4 | 90.0 | | | | 10.0 | | | | 100.0 | 100.0 | 0.0 | NG | S |
| 5 | 97.0 | 3.0 | | | | | | | 100.0 | 100.0 | — | NG | NG |
| 6 | 85.0 | 5.0 | | | 10.0 | | | | 100.0 | 100.0 | 0.5 | NG | S |
| 7 | 91.0 | 5.0 | | | 4.0 | | | | 100.0 | 100.0 | 1.3 | NG | NG |
| 8 | 80.0 | 6.0 | 7.0 | | 7.0 | | | | 93.0 | 100.0 | 1.9 | S | NG |
| 9 | 50.0 | 45.0 | | | 5.0 | | | | 100.0 | 100.0 | 9.0 | S | NG |
| 10 | 40.0 | 50.0 | | | 10.0 | | | | 100.0 | 100.0 | 5.0 | S | NG |
| 11 | 59.0 | 20.0 | 5.0 | | 10.0 | | 6.0 | | 89.0 | 100.0 | 1.6 | S | NG |
| 12 | 92.5 | 2.5 | | | 5.0 | | | | 100.0 | 100.0 | 0.5 | NG | A |
| 13 | 84.5 | 3.5 | | | 5.0 | | | 7.0 | 93.0 | 93.0 | 0.7 | NG | NG |
| 14 | 50.0 | 35.0 | 7.0 | | 5.0 | 3.0 | | | 90.0 | 100.0 | 5.3 | S | NG |
| 15 | 49.0 | 35.0 | | 8.0 | 5.0 | | 3.0 | | 89.0 | 100.0 | 5.4 | S | NG |
| 16 | 87.0 | 5.0 | | | 8.0 | | | | 100.0 | 100.0 | 0.6 | NG | A |
| 17 | 84.0 | 6.0 | | | 10.0 | | | | 100.0 | 100.0 | 0.6 | NG | S |
| 18 | 89.0 | 6.0 | | | 5.0 | | | | 100.0 | 100.0 | 1.2 | S | A |
| 19 | 86.0 | 6.0 | | | 8.0 | | | | 100.0 | 100.0 | 0.8 | S | S |
| 20 | 85.4 | 6.0 | | | 8.6 | | | | 100.0 | 100.0 | 0.7 | S | S |
| 21 | 80.0 | 15.0 | | | 5.0 | | | | 100.0 | 100.0 | 3.0 | S | A |
| 22 | 77.0 | 15.0 | | | 8.0 | | | | 100.0 | 100.0 | 1.9 | S | S |
| 23 | 70.0 | 25.0 | | | 5.0 | | | | 100.0 | 100.0 | 5.0 | S | A |
| 24 | 60.0 | 35.0 | | | 5.0 | | | | 100.0 | 100.0 | 7.0 | S | B |
| 25 | 56.0 | 35.0 | 4.0 | | 5.0 | | | | 96.0 | 100.0 | 7.8 | S | B |
| 26 | 51.0 | 35.0 | 4.0 | | 5.0 | | | 5.0 | 91.0 | 95.0 | 7.8 | S | C |
| 27 | 55.0 | 35.0 | 5.0 | | 5.0 | | | | 95.0 | 100.0 | 8.0 | S | C |
| 28 | 51.0 | 35.0 | 6.0 | | 5.0 | 3.0 | | | 91.0 | 100.0 | 5.1 | S | C |
| 29 | 51.0 | 35.0 | | 6.0 | 5.0 | | 3.0 | | 91.0 | 100.0 | 5.1 | S | C |
| 30 | 52.0 | 42.0 | | | 6.0 | | | | 100.0 | 100.0 | 7.0 | S | B |
| 31 | 50.0 | 42.0 | | | 8.0 | | | | 100.0 | 100.0 | 5.3 | S | A |
| 32 | 61.0 | 33.0 | | | 6.0 | | | | 100.0 | 100.0 | 5.5 | S | B |
| 33 | 64.0 | 30.0 | | | 6.0 | | | | 100.0 | 100.0 | 5.0 | S | A |
| 34 | 83.0 | 7.0 | | | 10.0 | | | | 100.0 | 100.0 | 0.7 | S | S |
| 35 | 70.0 | 20.0 | | | 10.0 | | | | 100.0 | 100.0 | 2.0 | S | S |
| 36 | 50.0 | 40.0 | | | 10.0 | | | | 100.0 | 100.0 | 4.0 | S | S |
| 37 | 55.0 | 30.0 | | | 15.0 | | | | 100.0 | 100.0 | 2.0 | S | S |
| 38 | 45.0 | 40.0 | | | 15.0 | | | | 100.0 | 100.0 | 2.7 | S | S |

The examiner joined the intermediate members 20 having the respective tips 22 joined thereto, to electrode base members 19 by resistance welding, thereby providing spark plugs 10 corresponding to samples 1 to 38. Since each sample was subjected to a plurality of evaluation tests, multiple sets of the samples 1 to 38 produced under the same condition were prepared.

In Example 1, Rh, Ir, and Ru were used as elements of the R group, and Ni, Co, and Fe were used as elements of the Ni group. The samples 13 and 26 contained Mn and Cr in addition to Pt, the R group, and the N group. Table 1 shows: the composition of an alloy forming each tip 22 (mass %); the total of contents of Pt, Rh, and Ni (mass %); the total of contents of Pt, the R group, and the N group (mass %); and a value obtained by dividing the content of the R group by the content of the N group.

The composition of the alloy forming each tip 22 was analyzed by WDS analysis (acceleration voltage: 20 kV, spot diameter of measurement area: 10 μm) of EPMA (JXA-8500F, manufactured by JEOL Ltd.). In this composition analysis, the plurality of measurement points 27, 28, 29, and 30 (refer to FIG. 3) at the cross-section including the axial line O (center line) of the tip 22 were set at the center of the measurement area, and an arithmetic average value of a plurality of measured values at the measurement points 27, 28, 29, and 30 was calculated. The arithmetic average value was rounded off to the first decimal point, and quantitative determination for inevitable impurities not more than the detection limit was omitted. The results are shown in Table 1. In Table 1, blanks indicate that the corresponding elements are not more than the detection limit in the WDS analysis of the EPMA.

If a measurement area in which a spot diameter was considered at each of the measurement points 27, 28, 29, and 30 was included in the melt portion 21, the measurement result at that measurement point was excluded for the purpose of preventing accuracy of the composition analysis from degrading.

Durability Test

The examiner mounted each sample of the spark plug to an engine, and operated the engine to apply, to each sample, 3000 cycles, each cycle including 5 minutes of full throttle operation (4000 rpm) and 2 minutes of idling operation. In the full throttle operation, the temperature of a portion 1 mm distant from the front end of the electrode base member 19 (ground electrode 18) toward the metal shell 17 side reached 1000° C.

Evaluation for Wear of Intermediate Member

After the test, the examiner dismounted each sample from the engine, and observed the cross-section orthogonal to the axial line O of the intermediate member 20 with a microscope, to measure a radial length x of a portion, of the intermediate member 20, that was not oxidized. Before the test, the examiner measured an outer diameter R1 of the intermediate member 20 in advance by using a projector. The examiner calculated a ratio of the length x of the non-oxidized portion to the outer diameter R1 (x/R1 (%)). The examiner evaluated samples having the ratio not less than 70%, as "excellent (S)", and evaluated samples having the ratio less than 70%, as "no good (NG)". The results are shown in the column of "Wear of intermediate member" in Table 1.

Evaluation for Hollow

Before the test, the examiner captured images of the intermediate member 20, the melt portion 21, and the tip 22 in advance by using an X-ray fluoroscopic apparatus. After the test, the examiner dismounted the sample from the engine, performed appearance inspection on the sample, and specified a portion, of the melt portion 21, having a remarkable hollow by using the X-ray fluoroscopic apparatus. Then, the examiner observed, with a microscope, a cross-section including the portion having the remarkable hollow and the axial line O of the tip 22, to measure a length d of a portion (remaining portion), of the melt portion 21, having the shortest length in the radial direction. Based on the information about the melt portion 21 image-captured before the test, the examiner obtained an outer diameter R2 of the portion, of the melt portion 21, corresponding to the length d, and calculated a ratio (residual ratio) of the length d to the outer diameter R2 (d/R2(%)).

The examiner evaluated the samples as follows. That is, samples having the residual ratio, of the melt portion 21, not less than 95% were "particularly excellent (S)", samples having the residual ratio not less than 90% and less than 95% were evaluated as "excellent (A)", samples having the residual ratio not less than 85% and less than 90% were evaluated as "good (B)", samples having the residual ratio not less than 80% and less than 85% were evaluated as "satisfactory (C)", and samples having the residual ratio less than 80% were evaluated as "no good (NG)". The results are shown in the column of "Hollow" in Table 1.

Results

As shown in Table 1, the samples 1, 2, 5, 7 to 11, and 13 to 15 were evaluated as "NG" for hollow. Regarding the samples 1, 2, and 5, the reason for this evaluation is inferred as follows. Since the samples 1, 2, and 5 contain none of the elements of the N group, a stable oxide film cannot be formed on the surface of the melt portion 21, and occurrence of thermal stress in the melt portion 21 is not inhibited. As a result, oxidation cannot be inhibited, and wear due to falling-off of oxides cannot be inhibited, and therefore, the melt portion 21 is hollowed. Regarding the sample 7, it is inferred that, since the sample 7 contains only 4.0 mass % of the element of the N group, a stable oxide film is not easily formed on the melt portion 21, and occurrence of thermal stress in the melt portion 21 is not inhibited, and therefore, the melt portion 21 is hollowed.

Regarding the sample 8, it is inferred that, since the sample 8 contains more Ir than Rh among the elements of the R group, the melt portion 21 is likely to be oxidized, and therefore, the melt portion 21 is hollowed. Regarding the sample 9, it is inferred that, since the value (R/N) obtained by dividing the content of the R group by the content of the N group is as large as 9.0, occurrence of thermal stress in the melt portion 21 is not inhibited, and an oxide film is not easily formed on the surface of the melt portion 21, which causes the melt portion 21 to be hollowed. Regarding the sample 10, it is inferred that, since the sample 10 contains less Pt than Rh, the melt portion 21 is brittle, thereby causing a remarkable hollow. Regarding the sample 11, it is inferred that, since the total (Pt+Rh+Ni) of the contents of Pt, Rh, and Ni is as low as 89.0 mass %, oxidation resistance of the melt portion 21 is degraded, which causes a remarkable hollow.

Regarding the sample 13, it is inferred that, since the total (Pt+R+N) of the contents of Pt, R group, and N group is as low as 93.0 mass %, the melt portion 21 is likely to be oxidized, and the melt portion 21 is hollowed due to stress resulting from internal oxidation. Regarding the samples 14 and 15, it is inferred that, since the totals of the contents of Pt, Rh, and Ni are as low as 90.0 mass % and 89.0 mass %, respectively, oxidation resistance of the melt portion 21 is degraded, which causes the melt portion 21 to be hollowed.

The samples 3 to 7, 12, 13, 16, and 17 were evaluated as "NG" for wear of the intermediate member 20. In each of the samples 3 to 7, 12, 13, 16, and 17, the content of Rh is as low as 0 to 5.0 mass %, or the value obtained by dividing the content of the R group by the content of the N group is less than 0.7. Therefore, it is inferred that the melting point of the tip 22 is low, and the distance between the intermediate member 20 and the center electrode 13 is short, which causes spark wear of the intermediate member 20 to accelerate, or it is inferred that embrittlement of the melt portion 21 is insufficient, and thereby the intermediate member 20 is deformed, and the oxide film formed on the surface of the intermediate member 20 peels off, which causes oxidation of the intermediate member 20 to accelerate.

All the samples 18 to 38 were evaluated as "S" for wear of the intermediate member 20, and none of the samples 18 to 38 were evaluated as "NG" for hollow. Among them, the samples 19, 20, 22, 31, and 34 to 38, each containing not less than 8 mass % of Ni, were evaluated as "S" or "A" for hollow. It is inferred that diffusion of the elements in the melt portion 21 is facilitated by Ni, and thereby a stable oxide film is easily formed on the surface of the melt portion 21, which inhibits oxidation of the melt portion 21.

The samples 18 to 25 and 30 to 38, in which the total of the contents of Pt, Rh, and Ni is not less than 96 mass %, were evaluated as "S", "A", or "B" for hollow. Meanwhile, the samples 26 to 29, in which the total of the contents of Pt, Rh, and Ni is not less than 91 mass % and less than 96 mass %, were evaluated as "C" for hollow. It is inferred that, in the samples 18 to 25 and 30 to 38, the melt portion 21 into which Pt, Rh, and Ni are melted is less likely to be oxidized as compared to the samples 26 to 29, and therefore, the melt portion 21 is inhibited from being hollowed.

The samples 18 to 23 and 33 to 38, in which the value obtained by diving the content of the R group by the content of the N group is not less than 0.7 and less than 5, were evaluated as "S" or "A" for hollow. It is inferred that, since the content of the N group is relatively higher than the content of the R group as compared to the samples 24 to 32, a stable oxide film can be easily formed on the surface of the melt portion 21, and therefore, the melt portion 21 is less likely to be brittle, and linear expansion coefficient of the melt portion 21 can be reduced, thereby reducing thermal stress in the melt portion 21. As a result, the melt portion 21 is inhibited from being hollowed.

Example 2

Production of Samples 39 to 70

The examiner prepared: various cylindrical tips 22 having the same size and being composed of compositions shown in Table 2; and intermediate members 20 each including a column portion 20*a* of the same size and a flange portion 20*b* of the same size, and being composed of 75.0 wt % of Ni, 23.5 wt % of Cr, 0.5 wt % of Al, 1.0 wt % of Si, and inevitable impurities not more than a detection limit. In the same manner as in Example 1, spark plugs 10 corresponding to samples 39 to 70 were obtained.

TABLE 2

| | Tip | | | | | | | | | | | | | |
|---|---|---|---|---|---|---|---|---|---|---|---|---|---|---|
| | Pt | R group (wt %) | | | N group (wt %) | | | Others | | | | Grain size | | |
| No. | (wt %) | Rh | Ir | Ru | Ni | Co | Fe | (wt %) | Pt + Rh + Ni | Pt + R + N | R/N | (μM) | Hb/Ha | Crack |
| 39 | 80.0 | 20.0 | | | | | | | 100.0 | 100.0 | — | 160 | 1.10 | NG |
| 40 | 83.0 | 7.0 | | | 10.0 | | | | 100.0 | 100.0 | 0.7 | <50 | 2.30 | B |
| 41 | 83.0 | 7.0 | | | 10.0 | | | | 100.0 | 100.0 | 0.7 | <50 | 2.25 | A |
| 42 | 83.0 | 7.0 | | | 10.0 | | | | 100.0 | 100.0 | 0.7 | <50 | 2.20 | A |
| 43 | 83.0 | 7.0 | | | 10.0 | | | | 100.0 | 100.0 | 0.7 | <50 | 2.15 | S |
| 44 | 83.0 | 7.0 | | | 10.0 | | | | 100.0 | 100.0 | 0.7 | <50 | 1.80 | S |
| 45 | 83.0 | 7.0 | | | 10.0 | | | | 100.0 | 100.0 | 0.7 | <50 | 1.50 | S |
| 46 | 83.0 | 7.0 | | | 10.0 | | | | 100.0 | 100.0 | 0.7 | <50 | 1.40 | S |
| 47 | 83.0 | 7.0 | | | 10.0 | | | | 100.0 | 100.0 | 0.7 | 100 | 1.10 | S |
| 48 | 83.0 | 7.0 | | | 10.0 | | | | 100.0 | 100.0 | 0.7 | 150 | 1.00 | S |
| 49 | 83.0 | 7.0 | | | 10.0 | | | | 100.0 | 100.0 | 0.7 | 200 | 1.00 | B |
| 50 | 70.0 | 20.0 | | | 10.0 | | | | 100.0 | 100.0 | 2.0 | <50 | 2.30 | B |
| 51 | 70.0 | 20.0 | | | 10.0 | | | | 100.0 | 100.0 | 2.0 | <50 | 2.25 | A |
| 52 | 70.0 | 20.0 | | | 10.0 | | | | 100.0 | 100.0 | 2.0 | <50 | 2.15 | S |
| 53 | 70.0 | 20.0 | | | 10.0 | | | | 100.0 | 100.0 | 2.0 | <50 | 1.60 | S |
| 54 | 70.0 | 20.0 | | | 10.0 | | | | 100.0 | 100.0 | 2.0 | 150 | 1.10 | S |
| 55 | 70.0 | 20.0 | | | 10.0 | | | | 100.0 | 100.0 | 2.0 | 180 | 1.00 | B |
| 56 | 51.0 | 35.0 | 4.0 | | 5.0 | | | 5.0 | 91.0 | 95.0 | 7.8 | <50 | 2.35 | B |
| 57 | 51.0 | 35.0 | 4.0 | | 5.0 | | | 5.0 | 91.0 | 95.0 | 7.8 | <50 | 2.25 | A |
| 58 | 51.0 | 35.0 | 4.0 | | 5.0 | | | 5.0 | 91.0 | 95.0 | 7.8 | <50 | 2.15 | S |
| 59 | 51.0 | 35.0 | 4.0 | | 5.0 | | | 5.0 | 91.0 | 95.0 | 7.8 | 160 | 1.10 | S |
| 60 | 50.0 | 42.0 | | | 8.0 | | | | 100.0 | 100.0 | 5.3 | <50 | 2.35 | B |
| 61 | 50.0 | 42.0 | | | 8.0 | | | | 100.0 | 100.0 | 5.3 | <50 | 2.25 | A |
| 62 | 50.0 | 42.0 | | | 8.0 | | | | 100.0 | 100.0 | 5.3 | <50 | 1.60 | S |
| 63 | 50.0 | 42.0 | | | 8.0 | | | | 100.0 | 100.0 | 5.3 | 200 | 1.00 | B |
| 64 | 61.0 | 33.0 | | | 6.0 | | | | 100.0 | 100.0 | 5.5 | <50 | 2.20 | A |
| 65 | 61.0 | 33.0 | | | 6.0 | | | | 100.0 | 100.0 | 5.5 | <50 | 2.15 | S |
| 66 | 61.0 | 33.0 | | | 6.0 | | | | 100.0 | 100.0 | 5.5 | 180 | 1.00 | B |
| 67 | 64.0 | 30.0 | | | 6.0 | | | | 100.0 | 100.0 | 5.0 | <50 | 2.30 | B |
| 68 | 64.0 | 30.0 | | | 6.0 | | | | 100.0 | 100.0 | 5.0 | <50 | 2.25 | A |
| 69 | 64.0 | 30.0 | | | 6.0 | | | | 100.0 | 100.0 | 5.0 | <50 | 2.10 | S |
| 70 | 64.0 | 30.0 | | | 6.0 | | | | 100.0 | 100.0 | 5.0 | 230 | 1.00 | B |

In Example 2, Rh, Ir, and Ru were used as elements of the R group, and Ni, Co, and Fe were used as elements of the Ni group. The samples 56 to 59 contained Mn and Cr in addition to Pt, the R group, and the N group. Table 2 shows: the composition of an alloy forming each tip 22 (mass %); the total of contents of Pt, Rh, and Ni (mass %); the total of contents of Pt, the R group, and the N group (mass %); and a value obtained by dividing the content of the R group by the content of the N group. Composition analysis for each tip 22 was performed in the same manner as in Example 1.

In Example 2, a crystal grain size of each sample at a cross-section parallel to the discharge surface 23 was calculated. In addition, a value of Hb/Ha was calculated by dividing Vickers hardness Hb obtained at the cross-section of the tip 22 before heat treatment at 1200° C. in an Ar atmosphere for 10 hours, by Vickers hardness Ha obtained at the cross-section of the tip 22 after the above heat treatment. The grain sizes and the values of Hb/Ha of the respective samples are shown in Table 2.

Durability Test and Evaluation for Tip Deformation

The examiner mounted each sample of the spark plug to an engine, and operated the engine for 200 hours so as to repeat a cycle including 5 minutes of full throttle operation (3500 rpm) and 1 minute of idling operation. In the full throttle operation, the temperature of a portion 1 mm distant from the front end of the electrode base member 19 (ground electrode 18) toward the metal shell 17 side reached 950° C.

During the operation of the engine for 200 hours, the size of the spark gap G between the discharge surface 23 of the tip 22 and the center electrode 13 was measured every 40 hours by using a pin gauge. The size of the spark gap G decreasing with progress of the test indicates that the tip 22 was deformed. Differences between the size of the spark gap G before the durability test and the sizes of the spark gap G measured every 40 hours during the durability test were obtained, and the largest value among the differences was regarded as a deformation amount (mm) of the tip 22.

Evaluation for Tip Cracking (Deformation)

After the durability test, the examiner observed, with a microscope, a cross-section including the axial line O of the tip 22 to determine whether or not any crystal grain was lost due to intercrystalline cracking at the discharge surface 23. Further, the examiner observed, with the microscope, the cross-section including the axial line O of the tip 22 to obtain the number of cracks and the lengths of cracks from the discharge surface 23.

The examiner evaluated the samples as follows. That is, samples having no falling-off of crystal grains and having no cracks as long as 0.15 mm or more, and samples having the tip deformation amount less than 0.05 mm, were evaluated as "excellent (S)". Samples having no falling-off of crystal grains and having at least one crack the length of which was not less than 0.15 mm and less than 0.2 mm, and samples having the tip deformation amount not less than 0.05 mm and less than 0.065 mm, were evaluated as "good (A)". Samples having no falling-off of crystal grains and having at least one crack the length of which was not less than 0.2 mm, and samples having the tip deformation amount not less than 0.065 mm and less than 0.08 mm, were evaluated as "satisfactory (B)". Samples having falling-off of crystal grains and samples in which the tip deformation amount was not less than 0.08 mm, were evaluated as "no good (NG)". The results are shown in the column of "Crack" in Table 2.

Results

The sample 39 was evaluated as "NG" for crack. The reason for this evaluation is inferred as follows. That is, since the tip 22 contains Rh having an atomic radius close to that of Pt but does not contain Ni, the linear expansion coefficient of the tip 22 is smaller than that of the electrode base member 19. Further, grain growth is likely to occur, and the high-temperature strength is not sufficient. Therefore, stress in the tip 22 is increased, thereby causing intercrystalline cracking and deformation.

The samples 41 to 48, 51 to 54, 57 to 59, 61, 62, 64, 65, 68, and 69 were evaluated as "S" or "A" for crack. It is inferred that, since each of these samples has the crystal grain size not greater than 160 μm and satisfies Hb/Ha≤2.25, stress is less likely to concentrate to the crystal grain boundary, and further, recrystallization and grain growth in the tip 22 at high temperature are inhibited. As a result, intercrystalline cracking and deformation of the tip 22 and falling-off of crystal grains are inhibited.

Meanwhile, the samples 49, 55, 63, 66, and 70 were evaluated as "B" for crack. It is inferred that, since each of the samples 49, 55, 63, 66, and 70 has the crystal grain size greater than 160 μm, stress is likely to concentrate to the crystal grain boundary, and therefore, cracking and deformation are likely to occur at the crystal grain boundary.

The samples 40, 50, 56, 60, and 67 were evaluated as "B" for crack. It is inferred that, since each of the samples 40, 50, 56, 60, and 67 satisfies Hb/Ha>2.25, recrystallization and grain growth occur in the tip 22 at high temperature, and therefore, intercrystalline cracking and deformation of the tip 22 and falling-off of crystal grains are likely to occur.

The samples 43 to 48, 52 to 54, 58, 59, 61, 62, 65, and 69, each satisfying Hb/Ha≤2.15, were evaluated as "S" for crack. It is found that, when the crystal grain size is not greater than 160 μm and Hb/Ha≤2.15 is satisfied, the effect of inhibiting intercrystalline cracking and deformation of the tip 22 and falling-off of crystal grains can be improved.

Example 3

The examiner prepared: cylindrical tips 22 having the same size and being composed of 70 wt % of Pt, 20 wt % of Rh, 10 wt % of Ni, and inevitable impurities not more than a detection limit; and various intermediate members 20 being composed of compositions shown in Table 3, and each having a column portion 20*a* of the same size and a flange portion 20*b* of the same size. In the same manner as in Example 1, spark plugs 10 corresponding to the samples 71 to 78 were obtained.

TABLE 3

| | Intermediate member | | | | | | Wear of inter- |
|---|---|---|---|---|---|---|---|
| No. | Ni | Cr | Fe | Al | Si | Y | mediate member |
| 71 | 86.5 | 10.0 | | 2.5 | 1.0 | | NG |
| 72 | 48.1 | 32.0 | 17.0 | 1.8 | 1.0 | 0.1 | NG |
| 73 | 75.0 | 23.5 | | 0.5 | 1.0 | | S |
| 74 | 70.0 | 23.5 | 5.0 | 0.5 | 1.0 | | S |
| 75 | 65.9 | 23.5 | 9.0 | 0.5 | 1.0 | 0.1 | S |
| 76 | 72.6 | 25.0 | | 2.0 | 0.3 | 0.1 | S |
| 77 | 81.5 | 15.0 | | 2.5 | 1.0 | | S |
| 78 | 50.1 | 32.0 | 15.0 | 1.8 | 1.0 | 0.1 | S |

In Table 3, the composition (mass %) of an alloy forming each intermediate member 20 is shown. Composition analysis for each intermediate member 20 was performed in the same manner as in Example 1.

Evaluation for Wear of Intermediate Member

After conducting the same durability test as in Example 1 on each sample, the examiner evaluated wear of each intermediate member 20 in the same manner as in Example 1. The results are shown in the column of "Wear of intermediate member" in Table 3.

Results

The samples 73 to 78, each containing not less than 50 mass % of Ni, not less than 15 mass % of Cr, and not less than 0 mass % and not greater than 15 mass % of Fe, were evaluated as "S". It is inferred that, in each of the samples 73 to 78, a dense oxide film of Cr can be formed on the surface of the intermediate member 20, thereby inhibiting oxidation wear of the intermediate member 20.

Meanwhile, the samples 71 and 72 were evaluated as "NG". It is considered that this is because the sample 71 has the content of Cr as low as 10.0 mass %, and the sample 72 has the content of Ni as low as 48.1 mass % and the content of Fe as high as 17.0 mass %. Therefore, it is inferred that an oxide film is not easily formed on the surface of the intermediate member 20, thereby causing oxidation wear of the intermediate member 20.

Although the present invention has been described based on the embodiment, the present invention is not limited to the above embodiment at all. It can be easily understood that various modifications can be devised without departing from the gist of the present invention.

In each of the examples described above, Ir and Ru are used in addition to Rh as elements of the R group. However, the present invention is not limited thereto. As a matter of course, at least one element selected from W, Mo, Nb, and Re can be used instead of or in addition to Ir and Ru, as elements of the R group. The reason is as follows. Each of Ir, Ru, W, Mo, Nb, and Re has an atomic radius within a range of 1.25 to 1.34 angstroms, which is close to the atomic radius (1.30 angstroms) of Pt, and has a melting point within a range of 1963 to 3180° C., which is higher than the melting point (1769° C.) of Pt. Therefore, each of Ir, Ru, W, Mo, Nb, and Re can facilitate embrittlement of the alloy while preventing reduction of the melting point of the alloy.

In each of the examples described above, Co and Fe are used in addition to Ni as elements of the N group. However, the present invention is not limited thereto. As a matter of course, Cu can be used instead of or in addition to Co and Fe, as an element of the N group. The reason is as follows. Each of Ni, Co, Fe, and Cu has an atomic radius within a range of 1.15 to 1.17 angstroms, which is smaller than the atomic radius (1.30 angstroms) of Pt, and has a melting point within a range of 1083 to 1535° C., which is lower than the melting point (1769° C.) of Pt. Therefore, each of Ni, Co, Fe, and Cu can facilitate diffusion of the elements while reducing the melting point of the alloy to reduce stress.

In the embodiment described above, the tip 22 has a cylindrical shape, but the shape of the tip 22 is not necessarily limited thereto. As a matter of course, the tip 22 may have another shape. Examples of the other shape of the tip 22 include a truncated cone, an elliptic cylinder, and polygonal columns such as a triangular column and a rectangular column.

In the embodiment described above, the intermediate member 20 has the shape including the column portion 20*a* and the flange portion 20*b*, but the shape of the intermediate member 20 is not necessarily limited thereto. As a matter of course, the intermediate member 20 may have another shape. Examples of the other shape of the intermediate member 20 include a truncated cone, a cylinder, an elliptic cylinder, and polygonal columns such as a triangular column and a rectangular column.

In the embodiment described above, the ground electrode 18 is provided with the intermediate member 20, the melt portion 21, and the tip 22. However, the present invention is not necessarily limited thereto. As a matter of course, the intermediate member 20, the melt portion 21, and the tip 22 can be joined to the electrode base member 14 of the center electrode 13, instead of the tip 15 of the center electrode 13. Also in this case, the same function and effect as in the above embodiment can be achieved.

In the embodiment described above, the electrode base member 19 joined to the metal shell 17 is bent. However, the present invention is not necessarily limited thereto. As a matter of course, a linear electrode base member may be used instead of using the bent electrode base member 19. In this case, the front end of the metal shell 17 is extended in the direction of the axial line O, and the linear electrode base member is joined to the metal shell 17 such that the electrode base member is opposed to the center electrode 13.

In the embodiment described above, the axial line O of the center electrode 13 is aligned with the center axis of the tip 22, and the ground electrode 18 is disposed such that the tip 22 is opposed to the center electrode 13 in the direction of the axial line O. However, the present invention is not necessarily limited thereto. The positional relationship between the ground electrode 18 and the center electrode 13 can be appropriately set. As another example of the positional relationship between the ground electrode 18 and the center electrode 13, the ground electrode 18 may be disposed such that the side surface of the center electrode 13 is opposed to the ground electrode 18.

DESCRIPTION OF REFERENCE NUMERALS

10 spark plug
13 center electrode (second electrode)
18 ground electrode (first electrode)
19 electrode base member
20 intermediate member
21 melt portion
22 tip
23 discharge surface Having described the invention, the following is claimed:

1. A spark plug comprising:
a first electrode including
an electrode base member containing Ni as a main material,
an intermediate member which is formed of an alloy containing Ni as a main material, and is welded to the electrode base member so as to protrude from the electrode base member,
a tip formed of an alloy containing Pt as a main material, and
a melt portion formed by melting the intermediate member and the tip together; and
a second electrode opposing a discharge surface of the tip with a spark gap, wherein
the tip contains not less than 6 mass % of Rh, at least one element selected from an R group consisting of Rh, Re, Ir, Ru, W, Mo, and Nb, not less than 5 mass % of Ni, and at least one element selected from an N group consisting of Ni, Co, Fe, and Cu,
the tip contains Rh most among the elements of the R group, and contains Ni most among the elements of the N group,
the total of contents of Pt, Rh, and Ni is not less than 91 mass %,
the total of contents of Pt, the R group, and the N group is not less than 95 mass %, and
a value obtained by dividing the content of the R group by the content of the N group is not less than 0.7 and not greater than 8.

2. The spark plug according to claim 1, wherein
the tip has a grain structure in which a crystal grain size at a cross-section parallel to the discharge surface is not greater than 160 μm,
assuming that Vickers hardness at the cross-section of the tip after heat treatment on the tip at 1200° C. in an Ar atmosphere for 10 hours is Ha and Vickers hardness at the cross-section of the tip before the heat treatment is Hb, the grain structure and the composition of the tip are set to satisfy Hb/Ha≤2.25.

3. The spark plug according to claim 2, wherein Hb/Ha obtained by dividing the Vickers hardness Hb by the Vickers hardness Ha satisfies Hb/Ha≤2.15.

4. The spark plug according to claim 1, wherein the tip contains not less than 8 mass % of Ni.

5. The spark plug according to claim 1, wherein the value obtained by dividing the content of the R group by the content of the N group is not greater than 5.

6. The spark plug according to claim 1, wherein the intermediate member contains not less than 50 mass % of Ni, not less than 15 mass % of Cr, and not less than 0 mass % and not greater than 15 mass % of Fe.

7. The spark plug according to claim 1, wherein the total of the contents of Pt, Rh, and Ni is not less than 96 mass %.

* * * * *